US008986531B2

(12) United States Patent
Eckelberry et al.

(10) Patent No.: US 8,986,531 B2
(45) Date of Patent: Mar. 24, 2015

(54) BIO-ENERGY REACTOR

(75) Inventors: Nicholas Eckelberry, Los Angeles, CA (US); Michael Green, Pacheco, CA (US)

(73) Assignee: Ennesys SAS, Nanterre (FR)

( * ) Notice: Subject to any disclaimer, the term of this patent is extended or adjusted under 35 U.S.C. 154(b) by 490 days.

(21) Appl. No.: 13/162,562

(22) Filed: Jun. 16, 2011

(65) Prior Publication Data

US 2011/0308962 A1 Dec. 22, 2011

Related U.S. Application Data

(60) Provisional application No. 61/356,435, filed on Jun. 18, 2010.

(51) Int. Cl.

| | |
|---|---|
| ***C25B 1/02*** | (2006.01) |
| ***C25B 9/08*** | (2006.01) |
| ***C25B 9/00*** | (2006.01) |
| ***C25B 1/00*** | (2006.01) |

(52) U.S. Cl.
CPC ..... *C25B 1/003* (2013.01)
USPC ..... 205/340; 204/242; 204/252; 205/637

(58) Field of Classification Search
CPC ..... C25B 1/003
USPC ..... 205/340, 637; 204/260, 242, 252
See application file for complete search history.

(56) References Cited

U.S. PATENT DOCUMENTS

| | | | | | |
|---|---|---|---|---|---|
| 1,740,659 | A | * | 12/1929 | MacDonald | 204/260 |
| 1,988,932 | A | * | 1/1935 | MacDonald | 209/181 |
| 3,198,119 | A | * | 8/1965 | Mead | 417/50 |
| 3,315,270 | A | * | 4/1967 | Hersch | 204/272 |
| 3,409,530 | A | * | 11/1968 | Locke et al. | 204/196.33 |
| 3,479,873 | A | * | 11/1969 | Hermanns | 204/222 |
| 3,985,634 | A | * | 10/1976 | Larson et al. | 204/272 |
| 4,039,422 | A | * | 8/1977 | Packer | 204/272 |
| 4,169,033 | A | * | 9/1979 | Dunagan | 204/272 |
| 4,243,751 | A | * | 1/1981 | Swartz | 422/186 |
| 4,269,690 | A | * | 5/1981 | Graham, III | 204/272 |
| 4,437,954 | A | * | 3/1984 | Sammells et al. | 205/340 |
| 4,752,740 | A | * | 6/1988 | Steininger | 210/167.11 |
| 5,128,304 | A | * | 7/1992 | Ito | 502/242 |
| 5,783,052 | A | * | 7/1998 | Bakhir et al. | 204/272 |
| 5,858,199 | A | * | 1/1999 | Hanak | 204/272 |
| 6,269,261 | B1 | * | 7/2001 | Ootomo | 600/345 |
| 6,279,611 | B2 | * | 8/2001 | Uematsu et al. | 137/888 |
| 6,942,767 | B1 | * | 9/2005 | Fazzina et al. | 204/260 |

(Continued)

OTHER PUBLICATIONS

Encyclopedia Britannica, definition of conduit, available online at http://www.britannica.com/EBchecked/topic/131713/conduit.*

*Primary Examiner* — Colleen M Raphael

(74) *Attorney, Agent, or Firm* — Im IP Law PLLC; C. Andrew Im

(57) ABSTRACT

A system includes an ionic exchange conduit through which a flow of photosynthetic biomass is drawn capturing an electrical charge which is used to alternately power a photonic activated reservoir housing a living photosynthetic biomass suspended in a flowing liquid medium which self generates an electrical charge as it migrates towards and through a cathode separated from an anode by a membrane. Upon electrical transfer through the circuit an electrolysis process begins and releases hydrogen and oxygen into enclosed atmosphere chambers where these separated gases can be captured for use in a fuel cell.

19 Claims, 7 Drawing Sheets

(56) References Cited

U.S. PATENT DOCUMENTS

| | | | | |
|---|---|---|---|---|
| 7,491,453 | B2 * | 2/2009 | Logan et al. | 204/242 |
| 8,105,474 | B2 * | 1/2012 | Fan | 205/340 |
| 2006/0163056 | A1 * | 7/2006 | Grebenyuk et al. | 204/260 |
| 2007/0042480 | A1 * | 2/2007 | Rozendal et al. | 205/777.5 |
| 2007/0056842 | A1 * | 3/2007 | Roychowdhury | 204/164 |
| 2009/0127128 | A1 * | 5/2009 | Kitaori et al. | 204/260 |
| 2011/0107655 | A1 * | 5/2011 | Kempkes et al. | 204/158.21 |

* cited by examiner

BIO-ENERGY REACTOR

CROSS-REFERENCE TO RELATED APPLICATIONS

This application claims the benefit of U.S. Provisional Application No. 61/356,435 filed Jun. 18, 2010, which is incorporated by reference herein in its entirety.

BACKGROUND OF THE INVENTION

1. Field of the Invention

The invention relates to the production of gases from biomass and solar energy.

2. Background and Related Art

Implementation of the invention relates to altering the electrical properties of fluids while in a transition phase flowing through a specifically designed tube and capturing and storing electrolytic generated energy. This current is drawn and utilized to power a modified photonic galvanic cell during nighttime and clouded days, thereby increasing the production of electrolytic generated elemental hydrogen and oxygen which can be used in a fuel cell.

A photosynthetic dependant living organism biomass suspended in a life supporting liquid environment depends upon an internal electrical charge as part of the photosynthetic process to support growth and reproduction. These microorganisms consume nutrients consisting of a variety of organic minerals found within their liquid environment. These consumed minerals allow the individual microorganism cells to be electrically responsive. The microorganism cells therefore are conductive and as such possess positive and negative polarities. Furthermore the microorganisms' liquid environment itself is electrically conductive and is considered an electrolyte solution due to the mineral and chemical content in solution; its polarity fluctuates in nature in response to environmental changes or can be altered when artificially created.

Some types of photosynthetic microorganisms are capable of absorbing and retaining electrical voltage similar to a voltage capacitor which stores and discharges voltage once a full capacity has been reached. In the case of microorganisms suspended within a conductive liquid medium, once the limit of stored voltage has been achieved, individual cells release their excess voltage into the liquid environment. This charge and discharge activity can be measured with oxygen reduction potential, pH and conductivity meters and reflects the overall electrical state of the growth medium as the photosynthetic organisms uptake minerals, fix these minerals, and discharge gases as part of the photosynthetic and respiration processes.

The Calvin cycle represented in the overall formula: 3 $CO_2$+9 ATP+6 NADPH+6 H+→$C_3H_6O_3$-phosphate+9 ADP+8 Pi+6 NADP++3$H_2O$, demonstrates the fixing of Hydrogen protons (H+) to create carbohydrate. There has been a lot of attention paid to cellular hydrogen extraction as a potential for fuels and fuel cells.

Extraction of hydrogen from algae has focused principally on alteration of the chemical properties of algae in order to extract fixed hydrogen from the cell. One process requires genetic modification to overcome the perceived problems of oxygen hindering the production of hydrogen. The enzyme that actually releases the hydrogen, a reversible hydrogenase, is sensitive to oxygen. The process of photosynthesis produces oxygen, therefore normally stopping hydrogen production very quickly in green algae. Various genetic approaches attempt to create $O_2$-tolerant mutant versions to result in a commercial $H_2$-producing system that is cost effective, scalable to large production, non-polluting, and self-sustaining. Other methods, such as sulfur deprivation, do release hydrogen, but have not proven to be viable as one has to then recombine sulfur to ensure sustained growth.

Other processes utilize acids and heat to extract hydrogen from biomass. Still other methods using bases as reactants for the production of hydrogen. These methods involves the use of redox chemistry to create hydrogen. While chemical modification can result in the creation of hydrogen, such processes are constrained as large-scale production methods due to difficulties in removing the chemicals as part of an integrated production system. The bases and acids flocculate the biomass rendering it useless for further growth and contaminate the growth medium for reuse. Photosynthetic species, such as algae, can store a large amount of pure hydrogen; however, the method of extraction of elemental hydrogen is dependent on a pyrolysis method for the use of this gas which is not extracted from the biomass prior to use. Thus, there are significant ongoing difficulties in obtaining hydrogen from biomass.

Generating a current within a photonic galvanic cell splits water into its constituent parts. Sun-powered photosynthetically driven biological fuel cells have been utilized for some time. In one device, an electrical fuel cell is formed using two chambers, one placed in sunlight and supplied with nutrients and microorganisms which transfer light energy or photons into chemical energy in the form of algae or carbohydrate, and the other placed in the dark where the chemical energy is released by reducing bacteria that produce compounds that release electrons. A bridge is included in the device to provide a pathway for cations and anions without a transfer of material between chambers. Electrons are released to an anode of the device by sulfites generated from sulfates by bacterial action. The energy of this action is derived from the sun and is stored as bacterial metabolites, these being fed to the bacteria to drive the reduction reaction's generating compounds that, in turn, give up electrons to an electrode element.

In photosynthesis, four photons captured by a chlorophyll pigment system with an average energy of approximately 50 Kcals per einstein (the einstein is used in studies of photosynthesis) are needed to reduce one molecule of nicotinamide adenine dinucleotide phosphate (NADPH) at approximately 53 Kcals per mole. All chlorophyll in oxygenic organisms is located in thylakoids, and is associated with PS II, PS I, or with antenna proteins feeding energy into these photosystems. PS II is the complex where water splitting and oxygen evolution occurs. Upon oxidation of the reaction center chlorophyll in PS II, an electron is pulled from a nearby amino acid (tyrosine) which is part of the surrounding protein, which in turn gets an electron from the water-splitting complex. From the PS II reaction center, electrons flow to free electron carrying molecules (plastoquinone) in the thylakoid membrane, and from there to another membrane-protein complex, the cytochrome $b_6f$ complex.

The other photosystem, PS I, also catalyzes light-induced charge separation in a fashion basically similar to PS II: light is harvested by an antenna, and light energy is transferred to a reaction center chlorophyll, where light-induced charge separation is initiated. However, in PS I electrons are transferred eventually to NADP (nicotinamid adenosine dinucleotide phosphate), the reduced form of which can be used for carbon fixation. The oxidized reaction center chlorophyll eventually receives another electron from the cytochrome $b_6f$ complex. Therefore, electron transfer through PS II and PS I results in water oxidation (producing oxygen) and NADP reduction, with the energy for this process provided by light (2 quanta for each electron transported through the whole chain). A schematic overview of these processes is provided in FIG. 7. Therefore, the theoretical maximum conversion of photonic energy to reducing potential is approximately 25%. Tapping the energy as formed into carbohydrate leads to another reduction in the theoretical efficiency.

Although, in principle, the nature of the reactants is not limited, the fuel-cell reaction usually involves the combination of hydrogen with oxygen, as shown by Equation (1). At 25° C. and 1 atmosphere pressure, that is, standard temperature and pressure (STP), the reaction takes place with a free energy change (AG) of AG=056.69 kcal/mole, that is, 237,000 joules/mole water.

$$H_2(g)+\tfrac{1}{2}O_2(g)\rightarrow H_2O(l) \quad (1)$$

If the reaction is harnessed in a galvanic cell working at 100% efficiency, a cell voltage of 1.23 volts~results. In actual service such cells have shown steady-state potentials in the range 0.9-1.1 volts, with reported columbic efficiencies of the order 73-90%.

The most successful previous type is the $H_2$-$0_2$ fuel cell of the direct or indirect type. In the direct type, hydrogen and oxygen are used as such, the fuel being produced in independent installations. The indirect type employs a hydrogen-generating unit that can use as raw material a wide variety of fuel. The reaction taking place at the anode is as in Eq. (2), and at the cathode as in Eq. (3).

$$2H_2+4OH^-\rightarrow 4H_2O+4e^- \quad (2)$$

$$O_2+2H_2O+4e-\rightarrow 4OH^- \quad (3)$$

Because of the low solubility of $H_2$ and $0_2$ in electrolytes, the reactions take place at the electrode/electrolyte interface, requiring a large area of contact for a large electron flow. This is obtained with porous materials called upon to fulfill the following main duties: the materials must provide contact between electrolyte and gas over a large area, catalyze the reaction, maintain the electrolyte in a very thin layer on the surface of the electrode, and act as leads for the transmission of electrons.

One unmet challenge has been to produce hydrogen and oxygen from photosynthetically generated biomass, without harsh chemical alteration, genetic modification, or combined approaches, such as prokaryote and eukaryote using the power of sunlight as the preferred embodiment.

Another challenge has been the creation of a method of generating current to power the system when there is low sunlight or in the nocturnal cycle.

Present systems fail to provide scalability and low cost and cannot be incorporated into a system that continuously produces these valuable gaseous byproducts as part of a grow system where other valuable products are generated such as food and fuels.

Furthermore, the use of photosynthetic material to generate the constituent gases of fuel cells is of interest, as this type of energy (provided it was generated from photonic activity) would be a panacea for low-cost renewable energy production.

BRIEF SUMMARY OF THE INVENTION

Implementation of the invention relates to a passive apparatus for altering the dynamic properties of a fluid flowing within the apparatus by inducing turbulence while simultaneously generating an electrical charge which may be drawn and immediately utilized or stored. The apparatus includes a conduit configured from concentric tubes and electrodes and situated so as to be gravity fed with fluid from a larger container, tank, pond or other basin via a bypass tube or transfer passage. The body of the apparatus includes an outer (hereinafter referred to as primary) conduit and an inner (secondary) conduit composed of dissimilar or similar metals with high electrode potential, so as to function as a cathode/anode pair.

On their inner surfaces, these conduits are scored lengthwise with parallel spiraling grooves and/or are implanted with parallel protuberances which are curved lengthwise and in a spiral fashion so as to impart vortexial motion to the fluid flow and thus increase turbulence and surface area. Energy generated by the motion of the entrained fluid and its ionic interaction with the differential metals may be drawn as current by positive and negative terminals connected to the conduits. The fluid's electrical properties, and consequently its oxidation reduction potential (redox potential or ORP), may thereby be altered in order to optimize its adsorption of and reaction with secondary fluids. A plurality of similarly configured alternating anode and cathode conduits may be concentrically incorporated so as to potentiate both the turbulent flow induced by the spiraling inner profile of the conduits as well as the available electrical draw. The apparatus includes a plurality of terminals connected to any given anode or cathode conduit which may provide for increased electrical draw along the conduit flow. These terminals may be connected in parallel or in series. This voltage then can be stored in a battery or distributed to a load through a resistor-capacitor (RC) circuit.

This current is then stored or directly utilized by a reservoir which is used for the continuous harvesting of hydrogen and oxygen from a flowing fluid comprised of photosynthetic material in a growth medium exposed to sun or artificial light through a light delivery device comprised of a cathode and separated by a specifically designed membrane from an anode which abuts to a hydrogen collection chamber or cavity. The gases are recovered through a porting system which captures the gases for utilization in fuel cells or other end use. The use of flowing fluids mitigates heat build up and flocculation of the biomass. A method for increasing gas production utilizing pH modifiers can be re-used in the overall cultivation system.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE DRAWINGS

Figure 1:
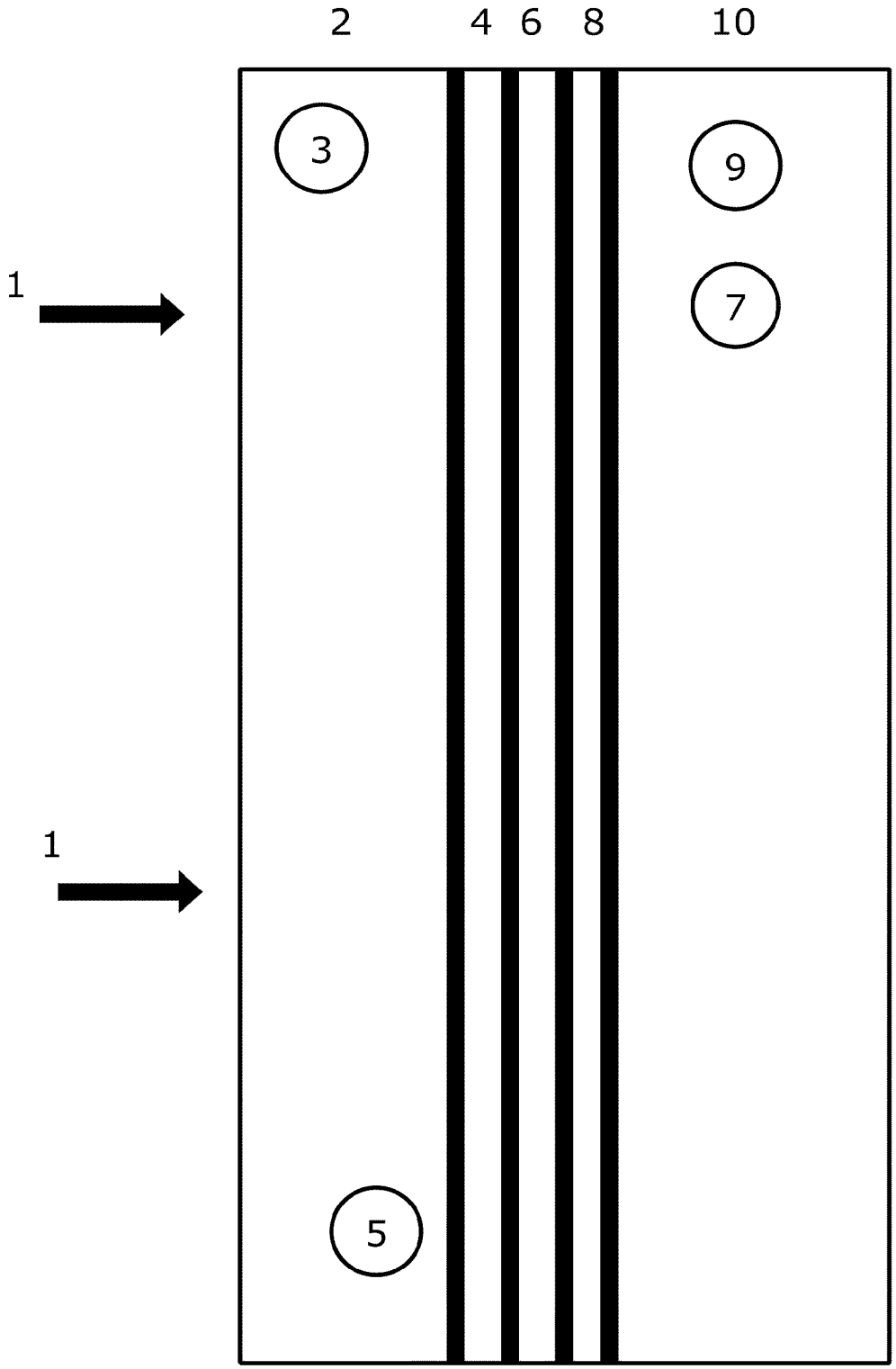
FIG. 1 illustrates a sectional view of a biomass apparatus.

FIG. 1: Illustrates a reservoir 2 which provides storage and confinement for a liquid dependent photosynthesis living biomass, illuminated by sunlight 1 and introduced through a conduit 3 and evacuated in a continuous flow through a conduit 5. These organisms provide a voltage catalysis for the release of electrons which radiate through an electrolyte capable liquid and migrates through the liquid towards an opposite polarity cathode 4. As these electrons pass through the cathode 4, the biomass liquid environment is approximately ninety percent blocked from passing by a membrane 6 but moisture is still allowed to soak into the membrane 6 which provides a pathway for transiting electrons to pass towards an anode 8. Upon electron transfer through the circuit, a decomposing of the liquid environment in contact with the anode 8 is broken down from a liquid compound into its elements of $H_2$ and $O_2$. Adjoining the anode 8 is an open chamber 10 where accumulating hydrogen atoms are collected through a port 9 as well as oxygen atoms through a port 7.

Figure 2:
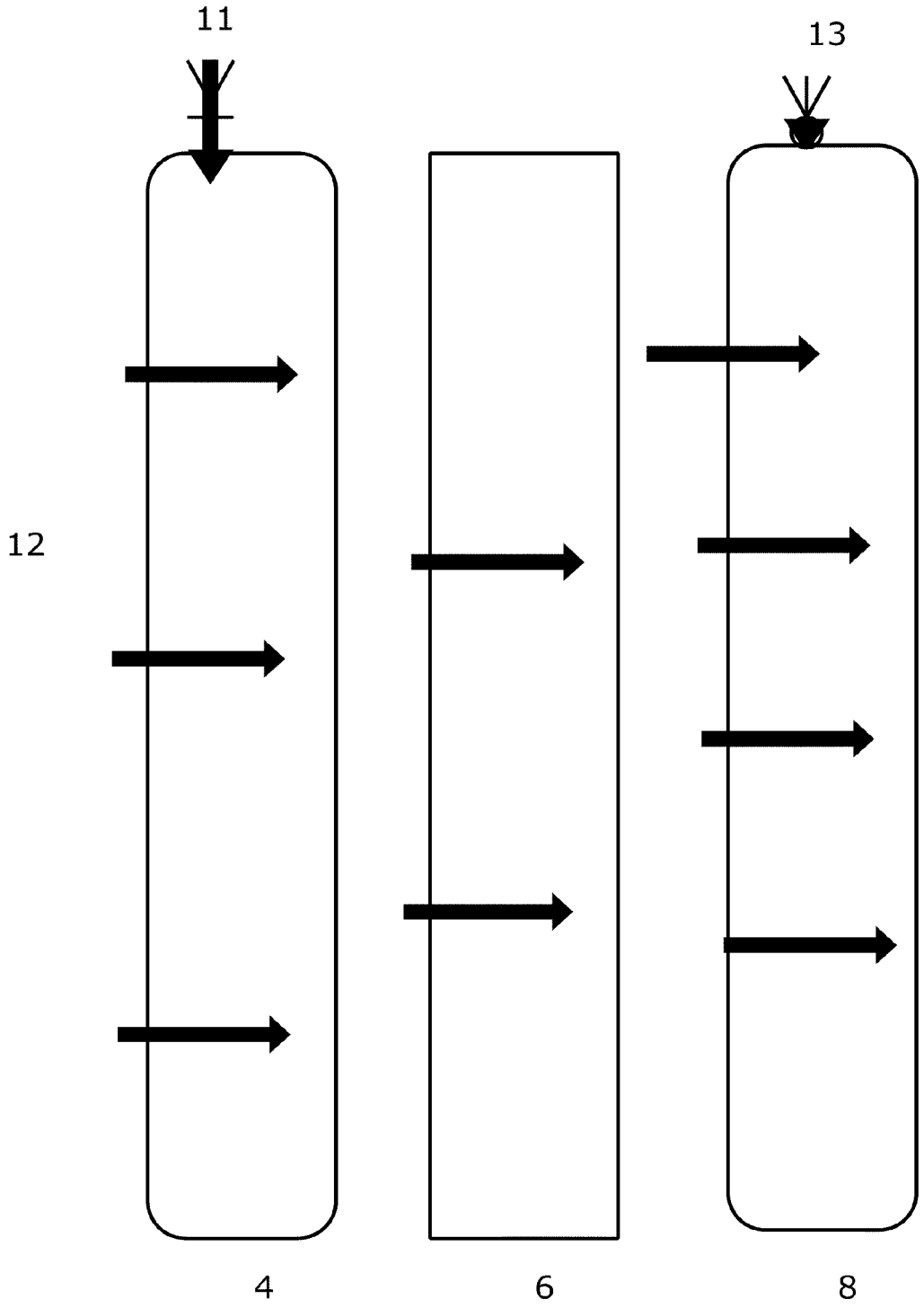
FIG. 2 illustrates a sectional view of an anode, membrane and cathode.

FIG. 2: Illustrates a single cathode 4 membrane 6 and anode 8 circuit which potentially could be placed in series to allow a scalable production rate of $H_2$ and $O_2$ to be harvested. The cathode 4 and anode 8 include a fine wire mesh that allows adsorption of the liquid environment into the membrane 6. This adsorption provides a path for flowing electrons 12 to transit through and to the anode 8 and where as the anode 8 being considered the negative side of the circuit, allows the positively charged hydrogen atoms to collect and accumulate. The cathode 4 includes a top-mounted electrode 11 which can be connected to an electrical priming device such as the modified conduit or an intermediary battery, likewise the anode 8 includes a top-mounted electrode 13 which can be connected to a modified conduit or intermediary battery terminal. Harvest is allowed from an adjoining enclosed open chamber 10 as illustrated in FIG. 1.

Figure 3:
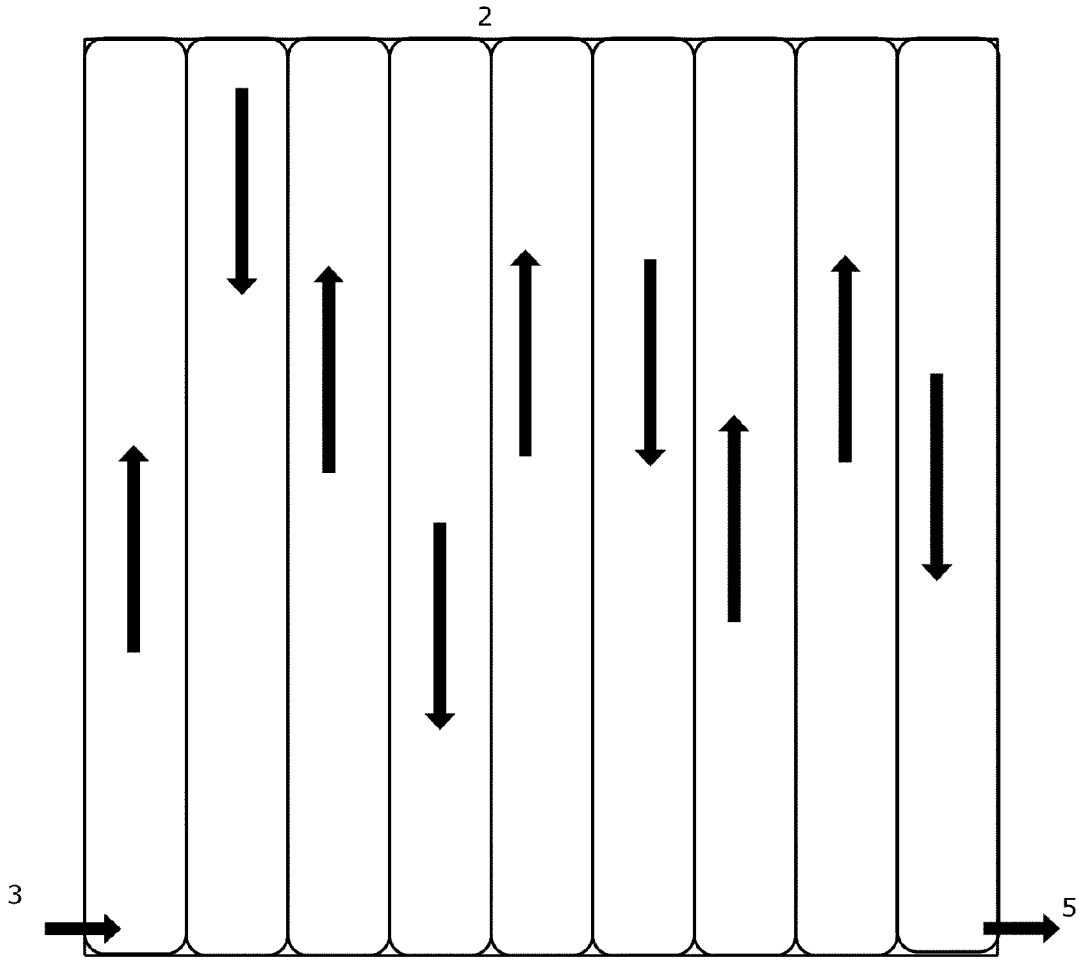
FIG. 3 illustrates a frontal view of a transition apparatus with serpentine clear tubing.

FIG. 3: Illustrates a design to increase contact area of the biomass and sunlight by flowing through a serpentine design in the primary reservoir 2 as introduced through port 3 and evacuated through port 5.

Figure 4:
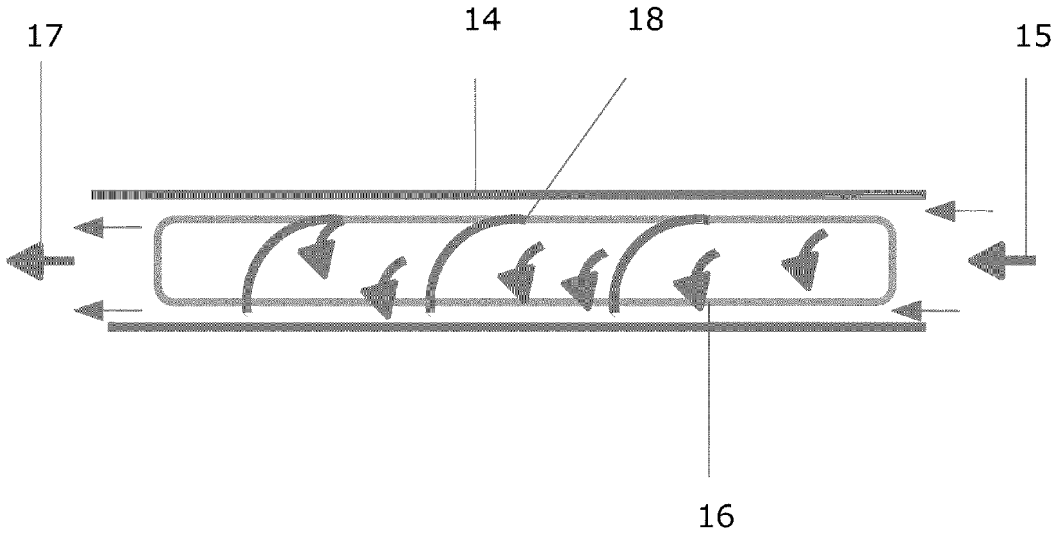
FIG. 4 describes a conduit within a conduit and the vortexial motion of fluids as it flows through the conveyance.

FIG. 4: Illustrates a conduit 18 within a conduit 14 and the vortexial motion 16 of fluid 15 as it flows 17 through the conveyance.

Figure 5:
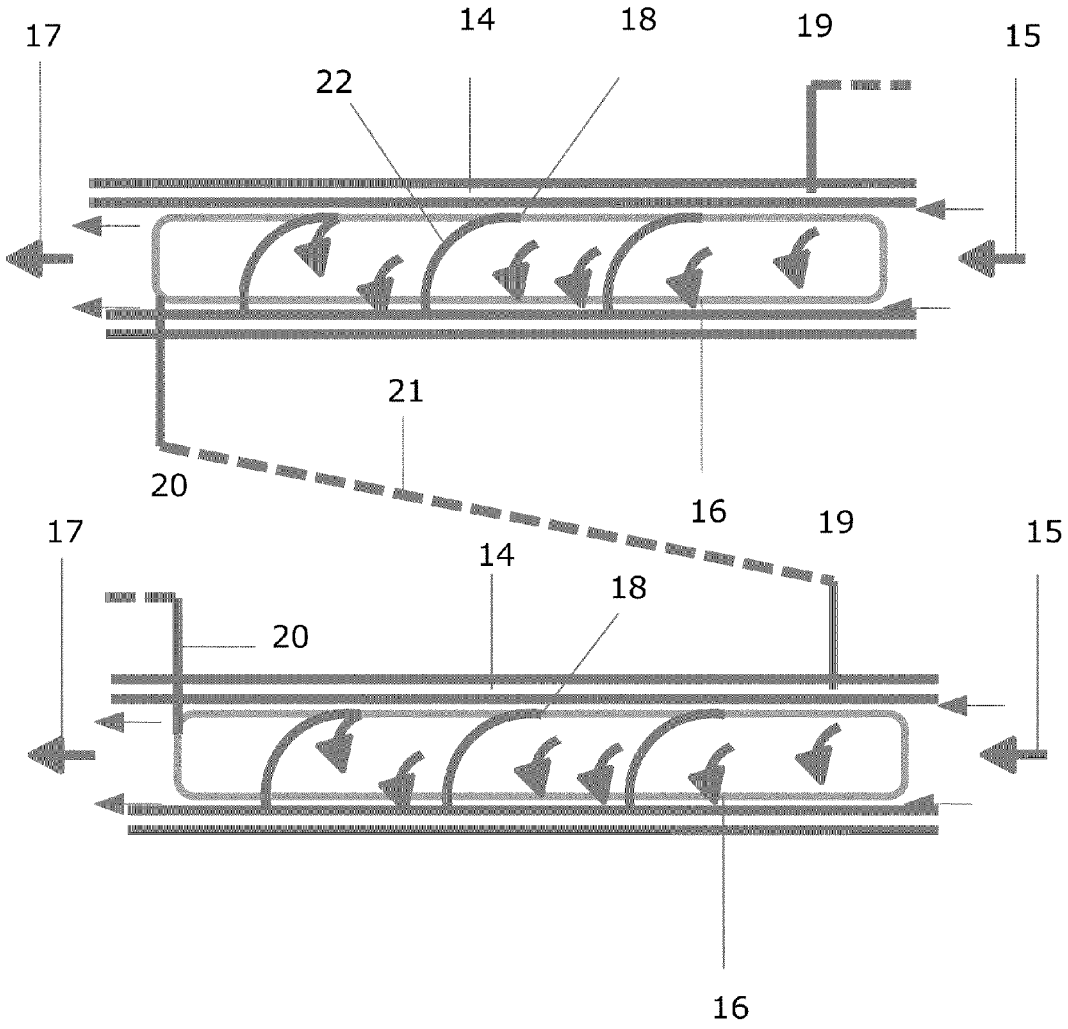
FIG. 5 describes two differing terminal configurations to the conduits.

FIG. 5: Illustrates a conduit 18 within a conduit 14 and the vortexial motion 16 of fluid 15 as it flows 17 through the conveyance modified by ridges or protuberances 22 and whose captured current is drawn from electrodes 19 and 20 with a possible connection in parallel 21.

Figure 6:
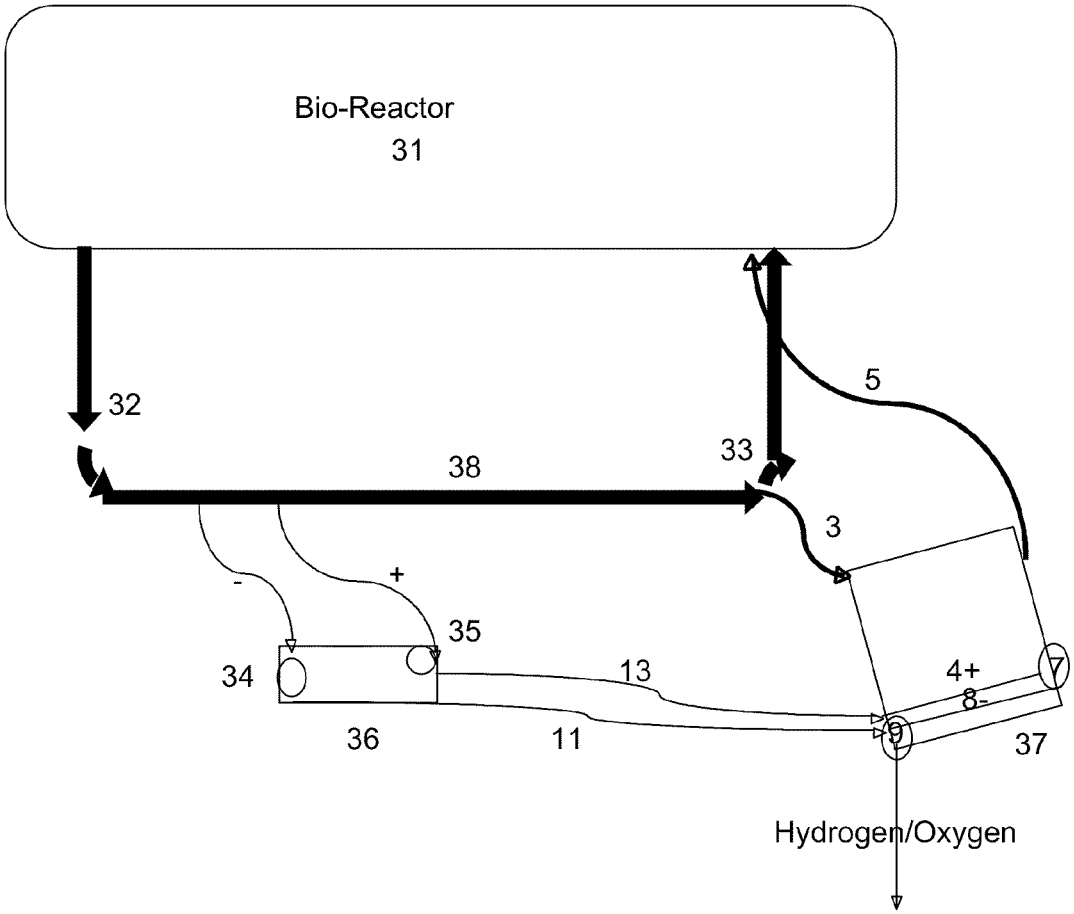
FIG. 6 illustrates a top view of a representational system.
Figure 7:
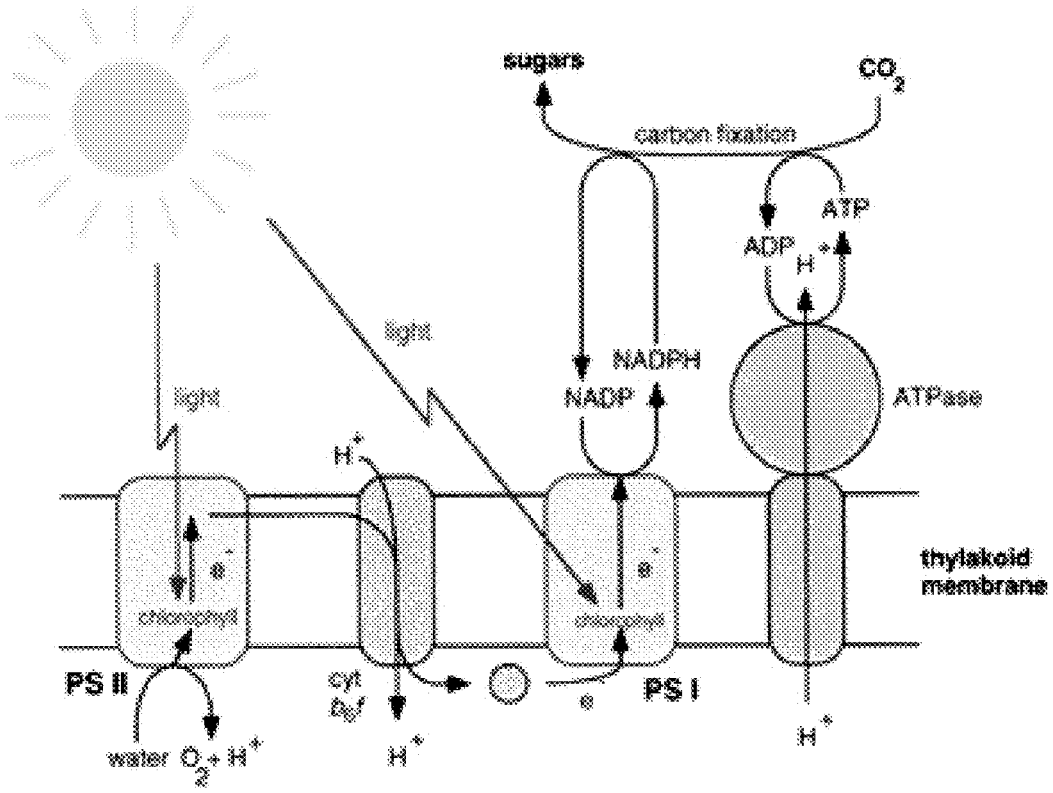
FIG. 7 illustrates processes associated with the PS II and PS I complexes.

FIG. 6: Illustrates a complete system where a spur is drawn off from bioreactor 31 through a conduit 32 and returned through a conduit 33. The fluid is entrained by gravity through the ionic transfer conduit 3 where current is drawn through wires 34, 35 and stored through an RC circuit and/or battery 36. The current is then transferred to cathode 4 and anode 8 on the harvester 37 where hydrogen and oxygen 7, 9 are collected as a result of the flowing biomass drawn and flowed through the harvester 37.

DETAILED DESCRIPTION OF THE INVENTION

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims. The following discussion is provided solely to assist the understanding of the reader.

The optimal condition for a photosynthetically driven fuel cell would be one in which the cells collecting sunlight had as their genetic-based biochemical directive that most of the photonic energy captured within the chloroplasts of the cells would be exported from within the living cells to outside of the cell organism, where it could be acted upon without further catabolism by any other organism to produce electrons with a negative standard reduction potential as close as possible to hydrogen (−0.42 volts).

Oxygen (+0.82 volts) produced by the water-splitting activity of photosynthesis would constitute a readily-available source of oxidant, and should be thought of as the oxidant of choice for accepting electrons at the cathode, whether the cathode is separated from the living cells to which oxygen is delivered, or is spatially set among the cells to which oxygen diffuses.

To demonstrate biomass voltage as a result of the redox process, a simple test was conducted to determine the voltage and conductivity of a 500 mg dried alga-mass as follows:

Natural Biomass Voltage: +110 mv*Conductivity Value: +6.08

In respiration and photosynthesis processes by which living cells produce or use energy, a change within the liquid medium occurs which is reflected in the metric pH (potential Hydrogen). As pH is a measurement for the potential of hydrogen ionic value in an aqueous solution, the reduction potential is a measure of the tendency of the solution to either gain or lose electrons when it is subject to change by introduction of a new species. A solution with a higher (more positive) reduction potential than the new species will have a tendency to gain electrons from the new species (i.e. to be reduced by oxidizing the new species) and a solution with a lower (more negative) reduction potential will have a tendency to lose electrons to the new species (i.e. to be oxidized by reducing the new species). Just as the transfer of hydrogen ions between chemical species determines the pH of an aqueous solution, the transfer of electrons between chemical species determines the reduction potential of an aqueous solution. Like pH, the reduction potential represents an intensity factor. It does not characterize the capacity of the system for oxidation or reduction; in much the same way that pH does not characterize the acidity. As pH value increases or decreases ORP will decrease or rise. For our purposes, ORP is the measurement of the electrical value of the state of an organic species in the overall growth medium as it acquires or donates electrons as part of the photosynthetic process. Oxygen Reduction Potential or redox is measured in millivolts, (mv) or Eh (1 Eh=1 mv).

To demonstrate the relationship between pH and the corollary ORP value, the following test was conducted using a 500 mg per liter density of Nanochloropsis algae biomass within a liquid growth medium defined for our purposes as the water and nutrient mineralization typically consisting of (by volume of concentrate): Fe 1.3%, Mn 0.034%, Co 0.002%, Zn 0.0037%, Cu 0.0017%, Mo 0.0009%, N 6.0%, Phosphate (P2O5) 2.0%, B1 0.07%, B12 0.0002%, Biotin 0.0002%, specifically: Ferric Chloride, EDTA, Cobalt Chloride, Zinc Sulfate, Copper Sulfate, Manganese Chloride, Sodium Molybdate Sodium Nitrate, Monosodium Phosphate, Thiamine, Hydrochloride (Vitamin B1), Vitamin B12, Biotin. In a salt water solution of 32 ppt and specific gravity of 1.02 at 82 F

| | |
|---|---|
| Starting pH: 8.6 | Starting ORP: +101 mv |
| pH: 8.0 | ORP: +153 mv |
| pH: 7.5 | ORP: +167 mv |
| pH: 7.0 | ORP: +174 mv |
| pH: 6.5 | ORP: +179 mv |
| pH: 6.0 | ORP +184 mv |

As clearly indicated, as the pH level dropped the ORP raised, reflecting an increase in the electrical potentials of the biomass and its liquid medium.

A system based on pH and more precisely ORP fluctuations of a photosynthetic organism could allow transitioning electrons released to accumulate and produce enough electrical energy to alter the liquid medium environment from a compound into the elemental of $H_2$ and $O_2$ through electrolysis. The electrolysis process engages when electrons are released into the liquid medium by incoming sunlight photons under the general chemical reversible formula: (AB+HOH ⇌ AH+BOH)

A primary test was conducted to show if a biomass in suspension flowing through a modified conduit could generate enough voltage to engender the process of electrolysis so as to increase production of gases in a photonic electrolysis device.

A second test was performed to see if similar results could be reproduced during a natural biomass dark cycle.

A third test was conducted to show if a liquid algae biomass had the electrical potential to chemically alter the liquid medium in a transition and if so, capture and measure the amount of hydrogen and oxygen released during direct sunlight exposure.

Test 1: Conduit Test: Bench Tests Results:

The prototype: a four foot long primary conduit with a two inch diameter outer wall and a equidistantly placed secondary (inner) conductive conduit was designed to provide a fluid flow pathway between the inside wall of the primary conduit and outside wall of the secondary conduit. The inner walls of both conduits, functioning as anode and cathode, were scored and set with a protruding silicone ridge spiraling throughout the length of the inner walls so as to impart a vortexial motion to the flow. Water was flowed through at differing speeds with the use of a simple recirculating pump for testing purposes.

Protocols:

The results were analyzed using the following instruments: Milwaukee SM500 ORP Meter, New MW500 and a Northern Industrial Digital Multifunction Voltmeter. Temperature +/−70 F OriginOil: ORP Testing Date: Apr. 5, 2011

Subtest A: Filtered Water:

Salinity: 0 Specific Gravity: 1000

Starting Static Voltage: 0.084 volts Oxygen Reduction Potential: +262 mV

Low Flow Rate: 1 liter per 20 seconds High Flow Rate: 4 liters per 60 seconds

Low Flow Rate Voltage: 1.442 volts High Flow Rate Voltage: 1.402 volts

Low Flow Rate ORP: +190 mV High Flow Rate ORP: +189 mV

Subtest B: Tap Water:

Salinity: 0 Specific Gravity: 1000

Starting Static Voltage: 0.044 volts Oxygen Reduction Potential: +265 mV

Low Flow Rate: 1 liter per 20 seconds High Flow Rate: 4 liters per 60 seconds

Low Flow Rate Voltage: 1.394 volts High Flow Rate Voltage: 1.364 volts

Low Flow Rate ORP: +203 mV High Flow Rate ORP: +202 mv

Subtest C: Salt Water:

Salinity: 16 Specific Gravity: 1.012

Starting Static Voltage: 001 volts Oxygen Reduction Potential: +261 mv

Low Flow Rate: 1 liter per 20 seconds High Flow Rate: 4 liters per 60 seconds

Low Flow Rate Voltage: 1.460 volts High Flow Rate Voltage: 1.425 volts

Low Flow Rate ORP: +150 mV High Flow Rate ORP: +105 mV

Subtest D: Nannochloropsis Bio-Algae

Salinity: 36 Specific Gravity: 1.026

Starting Static Voltage: −007 volts Oxygen Reduction Potential: 120 mv

Low Flow Rate: 1 liter per 20 seconds High Flow Rate: 4 liters per 60 seconds

Low Flow Rate Voltage: 1.297 volts High Flow Rate Voltage: 1.272 volts

Low Flow Rate ORP: +174 mV High Flow Rate ORP: +188 mV

Test 2:

A 250 ml reservoir with a clear window opening under which was positioned parallel to each other a sequence consisting of a cathode mesh, a membrane and an anode mesh abutting a hydrogen harvest chamber to demonstrate when the reservoir was filled with a Nanochloropsis (*N. oculata*) biomass in aqueous suspension, confirmed the process of chemical electrolysis and the generation of elemental $H_2$ and $O_2$.

The following is the test procedures utilized to determine whether this reaction would take place in the absence of light and or if direct sunlight exposure had any affect on energy transfer over the 4 hour test duration.

A hydrogen detection meter which measures in micro to milli moles elemental Hydrogen was used for hydrogen detection.

Brief Result Summary: A direct sunlight cycle did produce an overall better averaged as opposed to a darkness cycle.

EXAMPLE $H_2/O_2$ production rate was measured when the reservoir was covered with a black cover to replicate an algae dark cycle, as follows:

Start Time: 10:00 AM Bio Type: Nanochloropsis salt water species

Dry Cell Voltage: 24.3 mv Ambient Temperature: 70.7 F Bio pH: 8.88

Bio ORP: −056 Wet Cell Starting Voltage: 23.3 mv & rising

Power Input: Volts: 3.7 Amps: 0.216 Duration: 30 seconds

Starting Voltage in Cell after Input: 0.848 mv

Dark Duration of Operation: 10 AM to 2 PM/4 hours

Readings:

| | | | |
|---|---|---|---|
| 10:00 AM (start): | 68 Micromoles | Cell Voltage: | .251 mv |
| 10:30 AM | 132 Micromoles | Cell Voltage: | .179 mv |
| 11:00 AM | 132 Micromoles | Cell Voltage: | .134 mv |
| 11:30 AM | 122 Micromoles | Cell Voltage: | .134 mv |
| 12:00 PM | 112 Micromoles | Cell Voltage: | .112 mv |
| 12:30 PM | 102 Micromoles | Cell Voltage: | .090 mv |

-continued

| | | | |
|---|---|---|---|
| 1:00 PM | 84 Micromoles | Cell Voltage: | .076 mv |
| 1:30 PM | 74 Micromoles | Cell Voltage: | .071 mv |
| 2:00 PM | 68 Micromoles | Cell Voltage: | .064 mv |
| Ending Hydrogen Micromoles: | 68 Micromoles | Ending Cell Voltage: | .064 mv |

Test 3:

$H_2/O_2$ production rate were measured when the reservoir was exposed in direct sunlight to replicate a natural algae light cycle, as follows:

Start Time: 10:30 AM

Bio Type Nanochloropsis salt water species. Dry Cell Voltage: 06.3 mv

Bio pH: 9.0 Ambient Temperature: 73 F Bio ORP: −065

Wet Cell Starting Voltage: −07.2 mv

Power Input burst:

Volts: 3.5 Amps: 0.215 Duration: 30 seconds

Starting Voltage in Cell after Input: 902.mv and rising

Light Duration of Operation: 10:30 AM to 2:30 PM/4 hours

Readings:

| | | | |
|---|---|---|---|
| 10:30 AM (start): | 160 Micromoles | Cell Voltage: | .247 mv |
| 11:00 AM: | 170 Micromoles | Cell Voltage: | .220 mv |
| 11:30 AM | 160 Micromoles | Cell Voltage: | .154 mv |
| 12:00 PM | 154 Micromoles | Cell Voltage: | .105 mv |
| 12:30 PM | 150 Micromoles | Cell Voltage: | .089 mv |
| 1:00 PM | 88 Micromoles | Cell Voltage: | .070 mv |
| 1:30 PM | 60 Micromoles | Cell Voltage: | .064 mv |
| 2:00 PM | 50 Micromoles | Cell Voltage: | .064 mv |
| 2:30 PM | 16 Micromoles | Cell Voltage: | .063 mv |
| Ending Hydrogen Micromoles: | 16 Micromoles | Ending Cell Voltage: | .063 mv |

Result Summary: Average production rate during each ½-hour segment of Light Cycle yielded 112 micromoles of hydrogen.

Average production rate during each ½-hour segment of Dark Cycle yielded 86 micromoles of hydrogen.

Accordingly a system and apparatuses are herewith described comprised of an ORP-modifying and current-capture conduit in the first instance which is electrically connected to a photonic-driven apparatus which creates electrolysis to capture hydrogen thereby creating a diurnal and nocturnal system.

In the primary embodiment the fluid is gravity fed through the conveyance and split laterally between a primary conduit 14 whose inner surface has been tooled so as to create raised parallel ridges, protuberances or depressions 22 which spiral down the length of the conduit thereby imparting a vortexial motion to the flow and increasing its effective surface area while decreasing its potential energy and pressure (Bernoulli effect), and a secondary conduit 18. The secondary conduit 18 is of equal length and is similarly configured, but with a smaller circumference which allows it to nest within the primary conduit 14, allowing adequate room for fluid flow without. In practice and scale considerations, the gap between the primary conduit's inner surface and the outer surface of the secondary conduit 18 can vary from approximately 1 mm to approximately 10 cm or more depending on factors such as type of fluid, flow rates, desired ORP modification, etc. The gap between the primary conduit 14 and the secondary conduit 18, however sized, remains consistent throughout the length of the overall conduit combination.

Alternatively, the secondary (or central, in the case of plurally layered conduits) conduit 18 may in fact be a rod, and not a tube, provided it is connected to the RC circuit via electrode as described above and made of a material with sufficient electrical potential vis a vis its proximate conduit 14.

The primary 14 and secondary 16 conduits are respectively composed of or lined with dissimilar or in some cases similar metals, metal doped plastics or fiber compositions such as those commonly used in galvanic cells, such as zinc/copper, aluminum/nickel, stainless steel to stainless steel or other pairings of conductive metals. The metal choice will depend on the type of reactions desired, conductivity, reactivity to fluids, corrosion, wear and other considerations. It is understood that many forms of metal deposition methods can be used for coatings of the anode and cathode conduits 14, 18 beyond pure or compound metals, including, but not limited to, metals deposed onto a substrate through thermal, vapor and chemical vapor deposition of nano and doped nano metals for example.

In a further embodiment, to the primary conduit 14 and secondary conduit 16, additional conduits with similar configurations but correspondingly smaller circumferences can be nested or concentrically implanted, provided each succeeding conduit be of opposing polarity and positioned to allow sufficient space for fluid flow between conduit layers.

To each conduit (e.g. conduit 14 and conduit 18, or each of the nested conduits) is welded or otherwise connected a passive conductor, terminal, or electrode connecting the interior of the conduit to the exterior of the primary conduit 14, extending through, and insulated from any intermediary conduit layers. The placement of these terminals can vary. They may be on the same radial axis or on different radial axes for example, or may be at opposite ends of a conduit, as illustrated in FIG. 5 with electrodes 19 and 20. There can also be a plurality of terminals distributed throughout the length of the conduits, thereby increasing the points of voltage collection and ORP modification. The terminals can be placed so that the collection end on the interior of the conduit 14 projects into the fluid flow 17, thus creating additional vortices and increasing surface area and dynamism within the fluid flow 17. On the external ends of the terminals, connections are made to a central RC circuit which can act as a storage device through standard circuit design in order to uptake the flow-generated current. The current, should one desire, can be used as a source of energy for other purposes. This by-product which has to be bled off of the system to create the dynamic ORP shifts has value and can be used.

In the case of a plurality of conduits, the attachment of terminals will be as described previously. Each conduit will have one or more terminals welded to it, extending through, and insulated from intermediary conduit layers and terminating outside the external wall of the primary conduit 14. These terminals are then connected to the central RC circuit, as described below.

The plurality of terminals may be connected in series, where positive to positive and negative to negative are connected to a central RC circuit or battery 36 as shown in FIG. 6 for capture of the generated voltage as energy for storage or use.

In a further embodiment, the terminals and are connected in parallel when having a plurality of open ended positive and negative terminals, a connection to an open negative to a positive terminal produces a parallel circuit which allows voltage capture which is then relayed to the central RC circuit or battery 36 for energy storage or use.

A system as shown in FIG. 6 is described a conveyance such as a trough, pipe or other means is placed close to a body of water, mixing tank or grow tank, e.g. the bio-reactor 31, or any other vessel that serves to hold fluids and the fluid is flowed through a series of conduits 32 33 through the ORP modifier 38 as discussed above and shown in FIG. 4-5. The conveyance can include a fluid modifier injection port. The generated current is captured through the RC circuit or battery 36.

The system also includes an apparatus, herein referred to as the transition apparatus or harvester 37, which contains a living photosynthesis biomass flowed through the apparatus though sealed but ported by a clear window which allows the entry of light. Sandwiched between the reservoir 2 and the harvest open chamber 10 is an array composed of the cathode 4 and the anode 8 separated by the membrane 6, as illustrated in FIG. 1. Adjoining and open to the anode side, the harvest chamber 10 or cavity collects the generated gases through ports 7, 9 on the top of the transition apparatus. Although FIG. 1 shows an apparatus arranged with the anode 8 proximate the chamber 10, an alternative apparatus includes the cathode 4 and anode 8 separated by the membrane 6, but with the cathode 4 proximate the chamber 10. As shown in FIG. 6, the biomass flow through the reservoir 2 of the harvester 37 is received through conduit 3 from the ORP modifier 38 and is returned to the bio-reactor 31 or conduit 33 through conduit 5, permitting ongoing circulation of the aqueous biomass through the entire system.

In methods according to embodiments of the invention, gases and compounds are used to alter and control electrical factors within a living biomass in order to conduct an ongoing electrolysis process in their liquid growth environment.

In embodiments of the transition apparatus or harvester 37, the apparatus includes a sealed container. The sealed container includes a port or window made of clear plastic which allows electromagnetic radiation penetration to the anode 8 and cathode 4 plates separated by the membrane 6. The adjoining cavity or chamber 10 is connected to the anode 8, membrane 6, and cathode 4 array and this empty space makes contact with the anode side of the array.

The container can be constructed of a plurality of materials and sizes. The criteria for design will be resistance to weather and water tightness and various materials and methods of construction should be readily apparent from the discussion herein in conjunction with ordinary skill in the container construction art. One could anticipate a number of units constructed in a honeycomb fashion for example, which are united by conduits through which biomass is flowed. These would have the advantage of permitting swapping out any defective or failing units without affecting the whole system. In a further embodiment, these containers or transition apparatuses could be laid side by side on rafters in an enclosed building whereby light is diffused to the ports through natural light conduits such as fiber-optics or Fresnel lenses.

In some embodiments, the biomass is flowed through the reservoir in a single plane whereby the whole of the biomass is in contact with the cathode side and seeps through the membrane 6 to the anode side.

Some embodiments employ a plurality of containers nested within the main reservoir 2 or otherwise connected to the reservoir 2 to encompass the use of differing photosynthetic organisms. These nested reservoirs are connected to the anode and cathode plates either individually or through a series of conduits, or to minimize the membrane size by incorporating a plurality of plate arrays.

In other embodiments, the biomass is flowed through a sinew pattern set over the cathode 4 plate, as shown in FIG. 3. Utilizing such a serpentine design may increase surface area and the amount of algae biomass in contact with the cathode 4. A further advantage is an increase in porting which mitigates the pooling of gases on the plates. The porting of the gases occurs on the anode side to evacuate oxygen generated by the electrolysis current. This porting reduces the accumulation of oxygen present after oxygen generation by the electrolysis current, as excess oxygen can act as a hydrogen production inhibitor; furthermore, the oxygen can be used in a recombinant form for the creation of electricity in a fuel cell.

The reactions take place at the electrode/electrolyte interface and require a large area of contact for a large electron flow. It is anticipated that the porting will be designed to capture the majority of the gas concentrated on the plate through a system of ridges and protuberances along the cathode 4 plate. These protuberances and ridges also aid in the collection of gases if the plates are somewhat angled to preclude pooling of gases. As a further embodiment, the plates can be placed slightly askew of parallel so as to abet the transition and flow of gases upwardly.

To those versed in this art, it is reasonable to assume that a plurality of exhaust ports can be strategically placed as the size of the array expands. These ports can be placed at differing points of the array to mitigate pooling of gases and enhance evacuation and capture.

One important consideration in the design of the system is the material used to permit the introduction of light. The use of plastics as the window plate may assist in controlling of the dynamic ranges of the electromagnetic spectrum allowed to enter the apparatus. The range of the electromagnetic spectrum of importance may be considered to be in the approximately 280 nm to 2500 nm range which encompasses UVA and B at the low-end and near-Infra red at the top. Retaining certain wavelength values while mitigating others is of importance. For example, in the UV bandwidth, UVA (320-400 nm) and UVB (280-320 nm) are desirable, whereas UVC (100-280 nm) is considered germicidal and would harm the living culture.

In some embodiments, Fluoropolymers such as FEP and polyimides such as Kapton, PTFE, PVDF, FEP, and PEEK™ are plastics that can be used which avoid photo-oxidation of the plastic while retaining the transmission of valuable UV rays to the matrix. Other embodiments include colorizing the plastics with fluorescent whitening agents (FWA) as these increase conductivity and assist in transforming some UV light to the blue spectrum (~400 nm), which is desirable for promoting photosynthesis. There is evidence that portions of the upper end of the spectrum (infra-red (IR), medium and far-infra red) can excite and enhance the production of conductivity in the growth medium.

Some embodiments embrace the utilization of materials such as germanium, silicone, sapphire and/or nano-coated materials thereof that improve IR which increase production of energy since IR acts as an excitant in water through its absorption by the growth medium as heat. In certain embodiments, these nano-structured coatings can be applied to the surface of the plate reflecting inwardly sunlight or artificial light that mimics the electro-magnetic frequency of sunlight.

In a further embodiment, a reflecting surface such as a mirror or Mylar coated reflective surface is placed behind the anode section to further enhance light back towards the array. Testing with this method has shown increased production of gases without an excessive increase in heat as the flowing biomass acts as a cooling agent.

In some embodiments, a cathode 4 and anode 8 mesh herein referred to as the plates are separated by the membrane 6. The biomass is flowed towards the cathode side and a residual amount transpires through the membrane 6 towards the anode side where the $H_2$ is harvested in a dry cavity, chamber or collection tank 10.

As an example of the types of electrode configurations mentioned above, some embodiments incorporate an electrode set which has at least two parallel plate electrodes. If more than two such plate electrodes are used, anode and cathode plates alternate to make up the set. If desired, non electrode plates may be installed between successive electrode plates to serve as equipotential surfaces, thereby assisting in maintaining reasonably uniform electric fields between successive electrodes. The spacing between successive electrode plates is chosen such that appropriate electric field strengths and/or currents are generated between the electrodes. In particular illustrative cases, the electrode spacing is on the order of about 0.05 to 1.0 cm, 1.0 to 2.0 cm, 2 to 5 cm, 5 to 10 cm, 10 to 20 cm, 20 to 50 cm, 0.5 cm to 50 cm, or 5.0 to 50 cm.

The electrode plates will usually be sufficiently thick to have sufficient mechanical strength considering the material(s) of which to plate is constructed to allow normal handling without problematic deflection of or damage to the plate. In certain illustrative cases, the plate thickness will be on the order of about 0.2 to 0.5 mm, 1.0 to 2.0 mm, 2.0 to 5.0 mm, or 0.2 to 2.0 mm. The electrode plates surface can be chosen in view of several parameters, e.g. capacity, desired fluid residence time, and/or desired processing capacity. In particular examples, the individual electrode plates have exposed active areas of 1.0 to 5 $cm^2$, 5.0 to 10.0 $cm^2$, 10 to 50 $cm^2$, 50 to 200 $cm^2$, 200 to 1000 $cm^2$, or even more. Depending on the application (e.g. considering space available in a desired location and/or for providing appropriate residence time for medium flowing through the electrode set), different shapes of electrode plates may be desirable, e.g., commonly rectangular, which may be square or non-square rectangular. Non-square rectangular plates may, for example, have lengths and widths in a ratio of about 1.1:1 to 1.5:1, 1.5:1 to 3:1, 3:1 to 6:1, 6:1 to 10:1, 10:1 to 20:1, or greater than 20:1.

Electricity is generated due to electric potential difference between two electrodes. This potential difference is created as a result of the difference between individual potentials of the two metal electrodes with respect to the electrolyte. These values and the metals used are known to those practicing the art and are reiterated here to encompass all permutations possible in the design of the mesh plates and coatings following the formula: E° cell=E° cathode−E° anode where E° anode is the standard potential at the anode and E° cathode is the standard potential at the cathode as given in the table of standard electrode potentials, which is incorporated as referenced in Table 1:

TABLE 1

STANDARD ELECTRODE POTENTIALS

| Half-Reaction | E°V |
|---|---|
| $Li^+ + e^- \rightleftarrows Li$ | −3.04 |
| $K^+ + e^- \rightleftarrows K$ | −2.92 |
| $Ba^{2+} + 2e^- \rightleftarrows Ba$ | −2.90 |
| $Ca^{2+} + 2e^- \rightleftarrows Ca$ | −2.87 |
| $Na^+ + e^- \rightleftarrows Na$ | −2.71 |
| $Mg^{2+} + 2e^- \rightleftarrows Mg$ | −2.37 |
| $Al^{3+} + 3e^- \rightleftarrows Al$ | −1.66 |
| $Mn^{2+} + 2e^- \rightleftarrows Mn$ | −1.18 |
| $2H_2O + 2e^- \rightleftarrows H_2 (g) + 2OH^-$ | −0.83 |
| $Zn^{2+} + 2e^- \rightleftarrows Zn$ | −0.76 |
| $Cr^{2+} + 2e^- \rightleftarrows Cr$ | −0.74 |
| $Fe^{2+} + 2e^- \rightleftarrows Fe$ | −0.44 |
| $Cr^{3+} + 3e^- \rightleftarrows Cr$ | −0.41 |
| $Cd^{2+} + 2e^- \rightleftarrows Cd$ | −0.40 |
| $Co^{2+} + 2e^- \rightleftarrows Co$ | −0.28 |
| $Ni^{2+} + 2e^- \rightleftarrows Ni$ | −0.25 |
| $Sn^{2+} + 2e^- \rightleftarrows Sn$ | −0.14 |
| $Pb^{2+} + 2e^- \rightleftarrows Pb$ | −0.13 |

TABLE 1-continued

STANDARD ELECTRODE POTENTIALS

| Half-Reaction | E°V |
|---|---|
| $Fe^{3+} + 3e^- \rightleftarrows Fe$ | −0.04 |
| $2H^+ + 2e^- \rightleftarrows H_2 (g)$ | 0.00 |
| $S + 2H^+ + 2e^- \rightleftarrows H_2S (g)$ | 0.14 |
| $Sn^{4+} + 2e^- \rightleftarrows Sn^{2+}$ | 0.15 |
| $Cu^{2+} + e^- \rightleftarrows Cu^+$ | 0.16 |
| $SO_4^{2+} + 4H^+ + 2e^- \rightleftarrows SO_2 (g) + 2H_2O$ | 0.17 |
| $Cu^{2+} + 2e^- \rightleftarrows Cu$ | 0.34 |
| $2H_2O + O_2 + 4e^- \rightleftarrows 4OH^-$ | 0.40 |
| $Cu^+ + e^- \rightleftarrows Cu$ | 0.52 |
| $I_2 + 2e^- \rightleftarrows 2I^-$ | 0.54 |
| $O_{2\,(g)} + 2H^+ + 2e^- \rightleftarrows H_2O_2$ | 0.68 |
| $Fe^{3+} + e^- \rightleftarrows Fe^{2+}$ | 0.77 |
| $NO_3^- + 2H^+ + e^- \rightleftarrows NO_2 (g) + H_2O$ | 0.78 |
| $Hg^{2+} + 2e^- \rightleftarrows Hg (1)$ | 0.78 |
| $Ag^+ + e^- \rightleftarrows Ag$ | 0.80 |
| $NO_3^- + 4H^+ + 3e^- \rightleftarrows NO (g) + 2H_2O$ | 0.96 |
| $Br_2 + 2e^- \rightleftarrows 2Br^-$ | 1.06 |
| $O_2 (g) + 4H^+ + 4e^- \rightleftarrows 2H_2O$ | 1.23 |
| $MnO_2 + 4H^+ + 2e^- \rightleftarrows Mn^{2+} + 2H_2O$ | 1.28 |
| $Cr_2O_7^{2-} + 14H^+ + 6e^- \rightleftarrows 2Cr^{3+} + 7H_2O$ | 1.33 |
| $Cl_2 + 2e^- \rightleftarrows 2Cl^-$ | 1.36 |
| $Au^{3+} + 3e^- \rightleftarrows Au$ | 1.50 |
| $MnO_4^- + 8H^+ + 5e^- \rightleftarrows Mn^{2+} + 4H_2O$ | 1.52 |
| $Co^{3+} + e^- \rightleftarrows Co^{2+}$ | 1.82 |
| $F_2 + 2e^- \rightleftarrows 2F^-$ | 2.87 |

In some embodiments, the anode 8 is coated with a dark color to increase absorption of the light spectrum and create UV absorbance. An example of such a coating is dimethylbenzoyl, titanium dioxide and zinc phosphate and/or combinations thereof. A commercial example of this coating is available under the Rustoleum brand. In some embodiments, the use of carbon plates has shown good result as generating electricity sufficient to cleave water without imparting heavy metals, which is an attribute that has advantage in a live growth culture system.

Further embodiments include a grouping of metals such as are found in the lanthanum group of the periodic chart specifically cesium and barium coated metals. Further embodiments include the use of metals such as platinum, nano-platinum, palladium, and other metals known to art for their long life and resistance to wear, although such materials have higher costs. Additional embodiments include the use of nano or nano-doped material through annealing, thin film vacuum deposition onto base metals, with the goal of lowering costs, extending plate life and increasing voltage thereby increasing $H_2$ production.

The fact that redox occurs simultaneously in a cell favors the use of a cell separator. Cell separators are separate the products obtained at the two electrodes in a cell, e.g. in the electrolytic production of hydrogen and oxygen by water electrolysis where the requirement of safety in operation is important. Overall the material used as separators are varied and may simply be micro-porous separators or may possess specific ion transport characteristics. Permeable membranes permit the bulk flow of liquids through their structure and are thus non-selective regarding transport of ions or neutral molecules. In electrochemical processes these are referred to as diaphragms.

In some embodiments, the cell separator is placed midway between the anode 8 and the cathode 4. This spacing can vary and spacers may be placed on the four corners of the inner plates to separate the plates and allow the membrane 6 to float between the plates. This separation provides access to the membrane 6 should it require maintenance or replacement. It is also anticipated that the spacing would allow more or less biomass to flow through the cathode 4 to migrate towards the anode 8. This spacing can be, for example, as little as 3 mm to 15 mm.

In some embodiments, the membrane is composed of electrolytic capacitor paper; however the use of the following materials is incorporated as further embodiments depending on factors required such as costs, temperature and durability: asbestos fibers and glass fibers, PTFE paper felt, fiber, polypropylene asbestos sheet and composite fiber sheet, PVC asbestos on metal screen, copolymers ceramics coated asbestos, styrene AL2O3, $SiO_2$, Nafion $ZrO_2$, and porous PTFE glass fibers.

Embodiments also include a terminal soldered onto or otherwise electrically connected to the anode 8 and cathode 4 which terminates outside of the transition box. These terminals can be connected to a battery or other circuitry which stores or uses electricity created from a source within the growth system as seen above.

In a further embodiment, the array, cathode 4, membrane 6, and anode 8 may be stacked in a manner such as to increase the contact area with biomass. Such embodiments may be used with the use of lighting systems such as fiber-optic light delivery or other methods of light diffusion and distribution to the cathode anode array through the biomass.

As discussed above, embodiments of the invention relates to the flow of photosynthetic organisms through the transition apparatus. Our testing has focused on two primary species of organisms: Nanochloropsis (*N. oculata*) in a salt water solution and Synechocystis sp. PCC6803, a freshwater cyanobacterium.

In some embodiments, the use of algae (eukaryote) water species includes species known to the art as high value organism, that is organisms that can be grown easily and have valuable by-products such as food or fuel. The main four groups are broadly named: red algae (Rhodophyta), brown algae (Heteromontophyta), green algae (Chlorophyta) and diatoms (Diatomaceae). In further embodiments, the use of certain photosynthetic bacterium is included such as cyanobacteria as they have shown similar electrical value when used within the transition apparatus. In further embodiments, fungi which are non-photosynthetic eukaryotes or chemoorganotrophs, such as yeasts can be used. The use of yeasts in the transition apparatus is practical as a salt bridge to capture excess oxygen and release $CO_2$ which algae require for growth.

In some embodiments, the use of organic minerals increases growth and adds mineral ionization values to the growth mixture. These minerals include the following, but are not limited solely to these as differing species require specialized admixtures and mineralization to maintain growth: ferric chloride, EDTA, cobalt chloride, calcium, magnesium, iron, zinc sulfate, copper sulfate, manganese chloride, sodium molybdate, sodium nitrate, monosodium phosphate, thiamine, hydrochloride (vitamin B1), vitamin B12, and biotin.

In some embodiments, the transition apparatus is connected to an algae grow system through a system of piping and pumps sufficient to flow a minimal amount of growth material or portion of the liquid for use in the gaseous extraction system which is then processed in a fuel cell for the generation of electricity.

As mentioned above, ORP can be adjusted by the manipulation of the pH; where RO or distilled water is considered neutral pH of 7. At pH levels below 7, the matrix contains a plurality of protons (H+) in an amount exceeding the number of OH− ions. At a pH level of 7, the matrix is considered neutral and to have a balance between protons and OH− ions. At pH levels above 7, the matrix now contains a plurality of OH− ions in an amount exceeding the number of protons (H+). Thus, the pH scale is a relative scale of anion and cation balance. The differences between H+ and OH− concentrations is the acidity or alkalinity of the liquid environment housing the living biomass.

When $CO_2$ is introduced to the matrix, pH decreases and acidifies the growth medium thereby increasing the proton (H+) content of the matrix which enhances hydrogen migration to the anode 8. When the pH level is increased, the growth medium becomes more alkaline thereby increasing the hydroxyl value of the water (OH−) causing a decrease in free hydrogen to migrate to the anode(s) 8. During a photosynthesis light cycle the cells are actively in a growth mode and require an intake of $CO_2$ to complete the photosynthesis cycle, so this chemical modification of adding $CO_2$ is not deleterious to the system as a whole and provides an integrated solution.

To facilitate electrolysis, three main components are provided: 1) a liquid capable of ionic transfer, 2) a source of electrical input and 3) electrically conductive materials. This combination of circumstances allow an electron reduction and transfer to occur and in the case of embodiments of the present invention, between the anode 8 and the cathode 4 separated by the close-tolerance membrane 6.

Testing was conducted using a measured $CO_2$ injection based on pH every hour to determine if additional hydrogen production could be achieved and to monitor either an increase or decrease of biomass electrical values. This testing validates the ORP and pH factors as a metric for electrical value control as illustrated in the following durational test.

Table 2, below, illustrates a method which allows voltage manipulation to occur within a living liquid photosynthesis dependent biomass. Oxygen Reduction Potential, (ORP) and Potential Hydrogen Ion Concentration, (pH) factors can be manipulated within a living biomass liquid environment to create an electrolysis process.

Starting Data:

Starting Time: 10:00 AM Bio Type: Nanochloropsis
Dry Cell Voltage: −37.7 mv Bio pH: 8.52 Ambient Temperature: 72.3 F.
Bio ORP: +100 mv Bio Electrical Conductibility: +7.39
Bio Conductivity Factors: 73.9%
Wet Cell Starting Voltage: −38.9 mv
Power Input:

Volts: 3.6 Amps: .216 Duration: 30 seconds
Voltage in Cell after Power Input: .940 mv

| | | |
|---|---|---|
| 10:15AM 68 Micromoles | 800 mv (dropping) | |
| 10:30 AM 150 Micromoles | 414 mv | |
| 11:00 AM 136 Micromoles | 168 mv | |
| 2 minute $CO_2$ injection: 160 Micromoles | 195 mv | pH: 6.00 |
| 11:30 AM 146 Micromoles | 148 mv | pH: 6.19 |
| 12:00 PM 116 Micromoles | 114 mv | pH: 6.22 |
| 1 minute $CO_2$ injection: 122 Micromoles | 133 mv | pH: 6.04 |
| 12:30 PM 98 Micromoles | 106 mv | pH: 6.01 |
| 1:00 PM 84 Micromoles | 85.2 mv | pH: 6.05 |
| 1 minute $CO_2$ injection: 88 Micromoles | 130.2 mv | pH: 5.62 |
| 1:30 PM 54 Micromoles | 99.0 mv | pH: 5.64 |
| 2:00 PM 44 Micromoles | 75.5 mv | pH: 5.66 |
| 1 minute $CO_2$ injection: 50 Micromoles | 106.4 mv | pH: 5.51 |

| | |
|---|---|
| Beginning pH: 8.52 | Ending: 5.51 |
| Beginning ORP: 100 m | Ending 183 mv |
| Beginning Biomass Electrical Conductivity: 73.9 | Ending: 68.7 |
| Beginning Bio Conductivity Factors: 7.39 | Ending: 6.83 |

As shown in testing, when $CO_2$ is introduced as part of the hydrogen harvesting system, an increase in millivolts (ORP) did occur. Thus, injection of $CO_2$ allows for an increase in hydrogen production while pH decreased over each 30 minute segment.

One skilled in the art should readily appreciate that embodiments of the present invention are well adapted to achieving the ends and advantages mentioned, as well as those inherent therein. The methods, variances, and compositions described herein are presently representative of certain embodiments only, are exemplary, and are not intended as limitations on the scope of the invention. Changes therein and other uses will occur to those skilled in the art, which are encompassed within the spirit of the invention, as defined by the scope of the claims.

It will be readily apparent to one skilled in the art that varying substitutions and modifications may be made to the invention disclosed herein without departing from the scope and spirit of the invention. For example, variations can be made to the design, size and placement of electrodes as well as number of concentric conduits. Thus, such additional embodiments are within the scope of the present invention and following claims.

The invention illustratively described herein suitably may be practiced in the absence of any elements, limitation or limitations which is not specifically disclosed herein. For example, in each instance herein any of the terms "comprising", "consisting essentially of" and "consisting of" may be replaced with either of the other two terms. The terms and expressions which have been employed are used as terms of description and not of limitation, and there is not intention that in the use of such terms and expression of excluding any equivalents of the features shown and described or portions thereof, but it is recognized that various modifications are possible within the scope of the invention claimed. Thus, it should be understood that although the present invention has been specifically disclosed by certain embodiments and optional features, modifications and variations of the concepts herein disclosed may be resorted to by those skilled in the art, and that such modifications and variations are considered to be within the scope of this invention as defined by the appended claims.

Also, unless indicated to the contrary, where various numerical values or value range endpoints are provided for embodiments, additional embodiments are described by taking any two different values as the endpoints of a range or by taking two different range endpoints from specified ranges as the endpoint of an additional range. Further, specification of a numerical range including values greater than the ones include specific description of each integer value within that range.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A apparatus comprising:

a reservoir for storing a fluid containing a photosynthesis living biomass, the reservoir being configured to allow sunlight to illuminate the fluid to allow photonic energy in the form of electrons to be captured within cells of the photosynthesis living biomass;

an electrically-conductive primary conduit connected to the reservoir to allow the fluid to flow through the primary conduit, the primary conduit having a length and with a first terminal electrically connected thereto;

an electrically-conductive secondary conduit having a length similar to the length of the primary conduit, being disposed substantially entirely within the primary conduit such that the fluid flows between the primary and secondary conduit, and having a second terminal electrically connected thereto;

an electrical circuit or device electrically connected to the first and second terminals and configured to capture energy from a voltage difference existing at the first and second terminals, the voltage difference being generated by the release of the electrons from the cells of the photosynthesis living biomass caused by a change in an oxygen reduction potential of the fluid as it flows between the primary and secondary conduits.

2. An apparatus as recited in claim 1, wherein one of the primary conduit and the secondary conduit comprises an anode and the other of the primary conduit and the secondary conduit comprises a cathode.

3. An apparatus as recited in claim 1, wherein at least one of the primary conduit and the secondary conduit comprises a spiral protuberance in communication with the space between the primary conduit and the secondary conduit, whereby when the fluid flows longitudinally down the space, the spiral protuberance causes a spiraling or vortexial flow in the fluid.

4. An apparatus as recited in claim 3, wherein both of the primary conduit and the secondary conduit comprise spiral protuberances in communication with the space between the primary conduit and the secondary conduit.

5. An apparatus as recited in claim 3, wherein the secondary conduit comprises an additional spiral protuberance on an inner surface of the secondary conduit.

6. An apparatus as recited in claim 1, wherein the secondary conduit is one of:

hollow; and solid.

7. An apparatus as recited in claim 1, wherein the primary conduit and the secondary conduit are two of a plurality of nested conduits of a substantially-equal length and sharing a common longitudinal axis, wherein the nested conduits alternate between anode and cathode conduits, and wherein a space for flow of the fluid exists between each adjacently-nested pair of conduits.

8. An apparatus as recited in claim 7, wherein a spiral protuberance is provided in communication with each space between adjacently-nested pairs of conduits, whereby when the fluid flows longitudinally down the spaces, the spiral protuberances cause a spiraling or vortexial flow in the fluid.

9. An apparatus as recited in claim 1, wherein the space between the primary conduit and the secondary conduit is in fluid communication with a hydrogen harvesting device comprising:

a second reservoir connected to the primary conduit for receiving the fluid flowing thorugh the primary conduit;

a cathode;

an anode;

a membrane separating the cathode and the anode; and a chamber, wherein one of the cathode and the anode is exposed to the fluid in the second reservoir and the other of the cathode and the anode is exposed to the chamber, the chamber being configured to collect hydrogen gas resulting from electrolysis in the hydrogen harvesting device.

10. The apparatus of claim 9, wherein the reservoir and the second reservoir are the same reservoir or are otherwise connected to allow the fluid to flow from the second reservoir to the reservoir.

11. An apparatus for collecting hydrogen gas from a photosynthesis process, the apparatus comprising:

a reservoir for holding a photosynthetic living biomass and an aqueous liquid, the reservoir being configured to permit the introduction of light to the biomass and liquid, the reservoir comprising:

a cathode;

an anode;

a membrane separating the cathode and the anode;

a chamber, wherein one of the cathode and the anode is exposed to the aqueous liquid in the reservoir and the other of the cathode and the anode is exposed to the chamber, the chamber being configured to collect hydrogen gas resulting from electrolysis in the apparatus; and a device for modifying the oxygen reduction potential of the biomass and liquid to generate a residual voltage to supply to the cathode and anode of the reservoir, the device comprising:

an electrically-conductive primary conduit having a length and with a first terminal electrically connected thereto;

an electrically-conductive secondary conduit having a length similar to the length of the primary conduit, being disposed substantially entirely within the primary conduit, and having a second terminal electrically connected thereto;

an electrical circuit or device electrically connected to the first and second terminals and configured to capture energy from a voltage difference existing at the first and second terminals caused by a modification to the oxygen reduction potential of the biomass and liquid as the biomass and liquid are flowed between the primary and secondary conduit.

12. An apparatus as recited in claim 11, further comprising at least one port in fluid communication with the chamber and configured to permit removal of hydrogen gas from the chamber.

13. A process for generating and collecting hydrogen gas from a photosynthetic living biomass comprising:

creating an electrical current in a photosynthetic living biomass in an aqueous liquid under conditions sufficient to initiate electrolysis, the biomass being contained in a hydrogen harvester apparatus comprising:

a reservoir for holding the photosynthetic living biomass and liquid;

a cathode;

an anode; and a membrane separating the cathode and the anode;

introducing carbon dioxide into contact with at least one of the photosynthesis living biomass and the aqueous liquid; and collecting the hydrogen gas produced as a result of such electrolysis.

14. The process according to claim 13, wherein the collected gas is used as a source of fuel for a fuel cell.

15. The process of claim 13, wherein the aqueous liquid comprises water.

16. The process of claim 13, wherein the step of creating the electric current comprises exposing the photosynthetic living biomass to light.

17. The process according to claim 16, wherein the electric current continues even after the living biomass ceases to be exposed to the light.

18. The process according to claim 13, further comprising causing a flow in the biomass and liquid whereby the biomass and liquid is caused to flow through the reservoir as well as through an apparatus comprising:

an electrically-conductive primary conduit having a length and with a first terminal electrically connected thereto;

an electrically-conductive secondary conduit having a length similar to the length of the primary conduit, being disposed substantially entirely within the primary conduit, and having a second terminal electrically connected thereto;

an electrical circuit or device electrically connected to the first and second terminals and configured to capture energy from a voltage difference existing at the first and second terminals; and a fluid space between the primary conduit and the secondary conduit, whereby an oxygen reduction potential of the liquid and biomass is altered and a residual voltage generated between the first and second terminals.

19. The process according to claim 18, wherein the residual voltage generated between the first and second terminals is used to create the electrical current in the photosynthetic living biomass.

* * * * *